US007111905B2

(12) United States Patent
Finney

(10) Patent No.: US 7,111,905 B2
(45) Date of Patent: Sep. 26, 2006

(54) TOY CUSHION FOR CHILDCARE

(76) Inventor: Catherine Finney, 1880 E. Morton, #123, Phoenix, AZ (US) 85020

( * ) Notice: Subject to any disclaimer, the term of this patent is extended or adjusted under 35 U.S.C. 154(b) by 0 days.

(21) Appl. No.: 10/893,653

(22) Filed: Jul. 16, 2004

(65) Prior Publication Data

US 2006/0011786 A1 Jan. 19, 2006

(51) Int. Cl.
*A47C 7/54* (2006.01)

(52) U.S. Cl. ..... 297/411.2; 446/352; 248/102

(58) Field of Classification Search ..... 248/102, 248/103; 446/352, 353, 356, 369
See application file for complete search history.

(56) References Cited

U.S. PATENT DOCUMENTS

| | | | | | |
|---|---|---|---|---|---|
| 1,247,547 | A | | 11/1917 | KoEune | |
| 1,639,442 | A | * | 8/1927 | Strauss et al. | 446/353 |
| 1,650,385 | A | | 11/1927 | Payton | |
| 2,057,551 | A | | 10/1936 | Bishop | |
| 3,737,196 | A | * | 6/1973 | Bodor | 297/181 |
| 4,895,327 | A | * | 1/1990 | Malone et al. | 248/102 |
| 4,944,704 | A | * | 7/1990 | Grace | 446/74 |
| 5,074,820 | A | * | 12/1991 | Nakayama | 446/29 |
| 5,083,732 | A | * | 1/1992 | Akamine | 248/104 |
| D329,836 | S | | 9/1992 | Meyers | |
| 5,211,282 | A | * | 5/1993 | Ting | 200/303 |
| 5,324,225 | A | * | 6/1994 | Satoh et al. | 446/175 |
| 5,332,288 | A | | 7/1994 | Coates | |
| D350,866 | S | | 9/1994 | Miller et al. | |
| 5,507,551 | A | | 4/1996 | Barry | |
| D369,929 | S | | 5/1996 | Perry | |
| 5,605,374 | A | | 2/1997 | Perry | |
| 5,624,090 | A | * | 4/1997 | Gammelgaard | 248/102 |
| D383,930 | S | | 9/1997 | Perry | |
| 5,664,828 | A | * | 9/1997 | Simon | 297/153 |
| 5,700,053 | A | | 12/1997 | Downing | |
| D412,583 | S | * | 8/1999 | Miller | D24/199 |
| 5,967,345 | A | | 10/1999 | Subotin | |
| 5,975,390 | A | | 11/1999 | Saroli | |
| D445,623 | S | | 7/2001 | Hartner | |
| 6,322,420 | B1 | * | 11/2001 | Daniellian | 446/300 |
| 6,371,826 | B1 | * | 4/2002 | Pestonji | 446/337 |
| 6,565,407 | B1 | * | 5/2003 | Woolington et al. | 446/175 |
| 6,824,112 | B1 | * | 11/2004 | Lange | 248/102 |
| 2002/0130538 | A1 | | 9/2002 | Artsvelyan | |
| 2003/0214162 | A1 | | 11/2003 | Romano et al. | |

* cited by examiner

*Primary Examiner*—Ramon O. Ramirez
*Assistant Examiner*—Steven Marsh
(74) *Attorney, Agent, or Firm*—Ellis & Venable, P.C.

(57) ABSTRACT

A toy armchair cushioning and entertainment apparatus for use by a caregiver interacting with a child. The apparatus is secured to the chair arm and a caregiver rests his or her arm on or against the apparatus while holding or cradling a child. Moreover, movement and/or music generated by the apparatus provides entertainment for the caregiver and child. A storage attachment provides a convenient place to store feeding bottles or frequently used items such as books or toys.

12 Claims, 3 Drawing Sheets

TOY CUSHION FOR CHILDCARE

BACKGROUND OF THE INVENTION

1. Field of the Invention

The invention is in the field of toys or childcare devices.

2. Discussion of the Related Art

Small children are often comforted or fed by adult caregivers. Moreover caregivers often sit for extended periods in a chair to feed or comfort a fussing child. While some chairs are substantially padded and comfortable, some chairs are comparatively rigid and uncomfortable to sit in for extended periods. Moreover, feeding small children can create messes.

The publications below list related art devices that can serve some use in the problems described above.

| | Patent No. or Publication Information | Named Person | Date |
|---|---|---|---|
| 1. | 1247547 | P C KoEune | Nov. 20, 1917 |
| 2. | 1650385 | H Payton | Nov. 22, 1927 |
| 3. | 2057551 | GE Bishop | Oct. 13, 1936 |
| 4. | D329836 | M Meyers | Sep. 29, 1992 |
| 5. | 5332288 | J H Coates | Jul. 26, 1994 |
| 6. | D350866 | C J Miller et al. | Sep. 27, 1994 |
| 7. | 5507551 | T P Barry | Apr. 16, 1996 |
| 8. | D369929 | M 0 Perry | May 21, 1996 |
| 9. | 5605374 | M 0 Perry | Feb. 25, 1997 |
| 10. | D383930 | M 0 Perry | Sep. 23, 1997 |
| 11. | D445623 | B Hartner | Jul. 31, 2001 |
| 12. | 5700053 | D Downing | Dec. 23, 1997 |
| 13. | 5967345 | J Subotin | Oct. 19, 1999 |
| 14. | 5975390 | D Saroli | Nov. 2, 1999 |
| 15. | 2002/0130538 | A Artsvelyan | Sep. 19, 2002 |
| 16. | 2003/0214162 A1 | Romano et al. | Nov. 20, 2003 |

The publications listed above can logically be divided into three categories; stuffed animal furniture, armchair cushions, and bottle or accessory holders. Among the stuffed animal furniture category are; U.S. Pat. No. 5,507,551 to Barry, which shows a stuffed bear chair, and U.S. Pat. No. D445623 to Hartner, which shows a stuffed hippo pillow. U.S. Pat. No. 5,967,345 to Subotin discloses a baby bottle and accessory holder. U.S. Pat. No. 1,247,547 to P C KoEune, U.S. Pat. No. 1,650,385 to H Payton, U.S. Pat. No. 2,057,551 to G E Bishop, D329836 to M Meyers, U.S. Pat. No. 5,332,288 to J H Coates, D350866 to C J Miller et al., D369929, U.S. Pat. No. 5,605,374 and D383930 to M O Perry, U.S. Pat. No. 5,700,053 to D Downing, U.S. Pat. No. 5,975,390 to D Saroli, 2002/0130538 to A. Artsvelyan, and 2003/0214162 A1 to Romano et al. disclose arm chair cushions. While each of the publications above discloses one or more useful devices, none disclose the apparatus described in the subject application.

SUMMARY OF THE INVENTION

Aspects of the invention are summarized below to aid in the understanding of embodiment(s) of the invention and the application. Yet, the invention is fully defined by the claims of the application.

The invention provides cushioning and entertainment while a caregiver interacts with a child. In one use, the invention is secured to the chair arm and a caregiver rests his or her arm on or against the invention while holding or cradling a child. Moreover, movement and/or music generated by the invention provides entertainment for the caregiver and child. A storage attachment provides a convenient place to store feeding bottles or frequently used items such as books or toys.

DESCRIPTION OF AN EMBODIMENT

Figure 1:
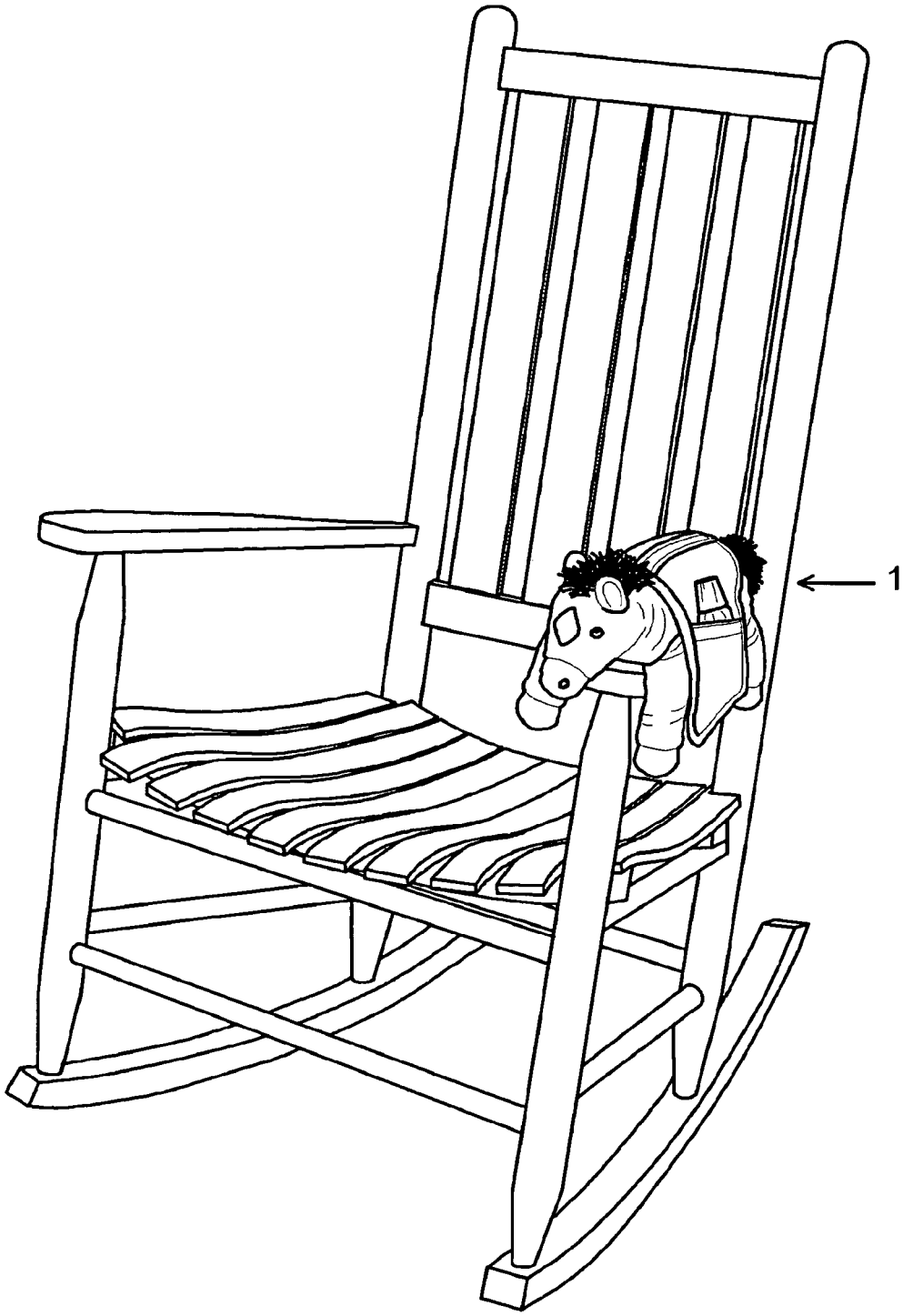
FIG. 1 illustrates an embodiment used with a rocking chair.

FIG. 1 illustrates the embodiment described herein attached to a rocking chair. The toy cushion 1 embodiment is securable to a chair arm and provides cushioning and entertainment. In one use, the toy cushion 1 is secured to the chair arm and a caregiver rests his or her arm on or against the toy cushion 1 while holding or cradling a child. Moreover, movement and/or music generated by the toy cushion 1 provide entertainment for the caregiver and child. A storage attachment provides a convenient place to store feeding bottles or frequently used items such as books or toys. While described herein as a "toy" cushion, the invention herein can fulfill other uses and be educational in nature as well as prevent spills from soiling the chair arm. Further, "toy" also describes models or representations of cartoon characters, animals, inanimate objects or people.

Figure 4:
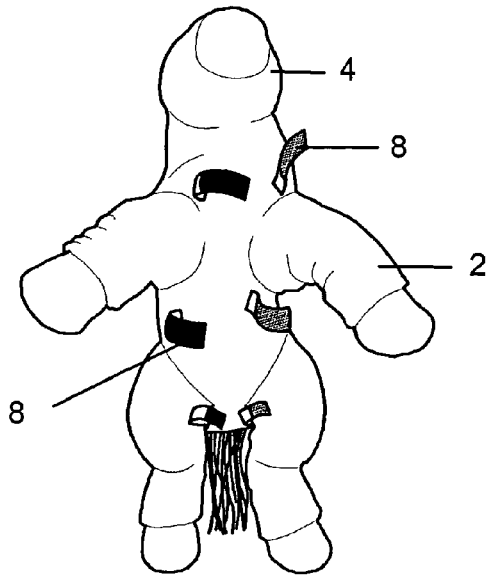
FIG. 4 illustrates a bottom view of the embodiment.

Most generally, the toy cushion 1 comprises at least a longitudinal cushion portion that is securable to a chair arm and a mechanically maneuverable portion that is preferably unsecured to the chair. The underside of the longitudinal toy cushion portion includes straps 8 to secure the toy cushion 1 to the chair arm as illustrated in FIG. 4. Preferred staps include a fastener type selected from the group consisting of hook and loop fastener, buttons, and snaps. The toy cushion 1 may also include cushioning in other dimensions and "longitudinal" is not meant to convey limitation on additional cushioning. The longitudinal cushion portion is manufactured to have sufficient padding or cushioning to provide comfort for a caregiver's arm holding at least a portion of a child's weight. Further, the longitudinal cushion portion is manufactured to be hypoallergenic, durable, flame retardant and washable. Embodiments may comprise an outer portion of synthetic fur material and an interior cushioning of closed-cell foam or an equivalent. In the illustrated embodiment, the longitudinal cushion portion is the stuffed toy torso portion 6 including the horse's back and its vicinity. Further, the mechanically maneuverable portion comprises a stuffed toy head portion 4. Alternate embodiments include additional or alternative mechanically maneuverable toy portions such as toy tail portions 5 or leg portions 2.

Figure 3:
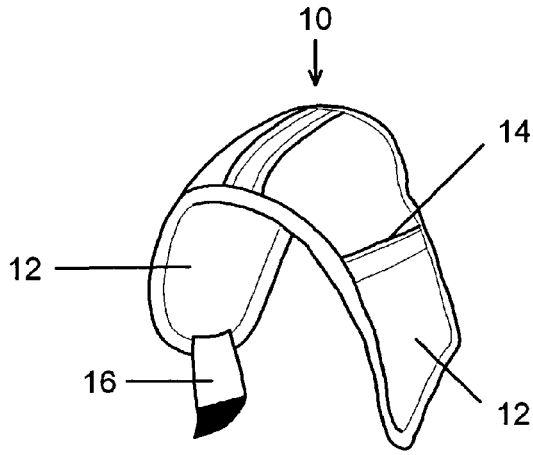
FIG. 3 illustrates an assembled perspective view of the embodiment.
Figure 3:
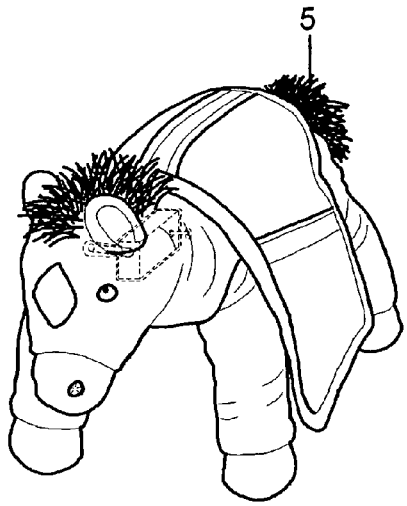
Figure 2:
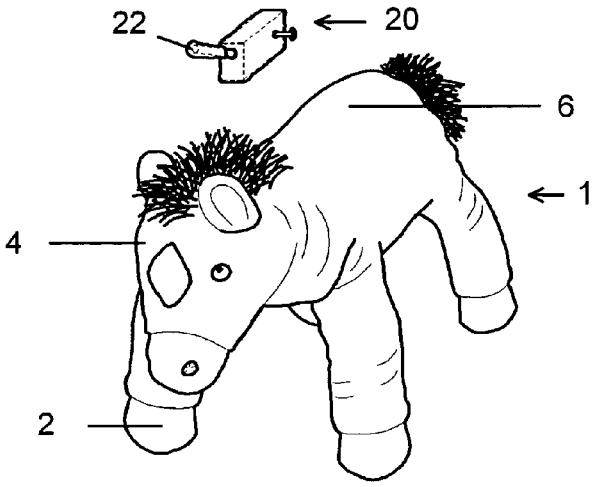
FIG. 2 illustrates components of an embodiment.

In preferred embodiments, the mechanically maneuverable portion is moved using a controller such as battery powered motor 20 with a guide that is positionable within the mechanically maneuverable toy portions of the toy cushion 1 embodiment. Alternate embodiments also feature "wind-up" motors or servos. FIGS. 2 and 3 illustrate an exemplary controller and guide as a battery powered motor 20 having a protruding member 22 that is positioned within or that extends into the toy cushion 1 neck and/or head portion 4. Activating the battery powered motor 20 causes the protruding member 22 to manipulate the stuffed toy head portion 4 for entertainment purposes. Alternate preferred embodiments include a controller having a Central Processing Unit, audible generator, and/or having music as an option.

Figure 5:
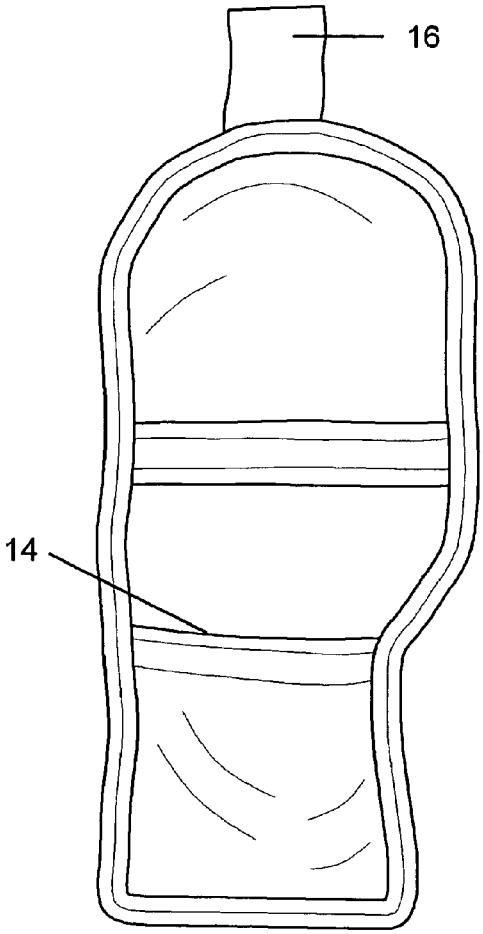
FIG. 5 illustrates a top view of an embodiment of the storage attachment.
Figure 6:
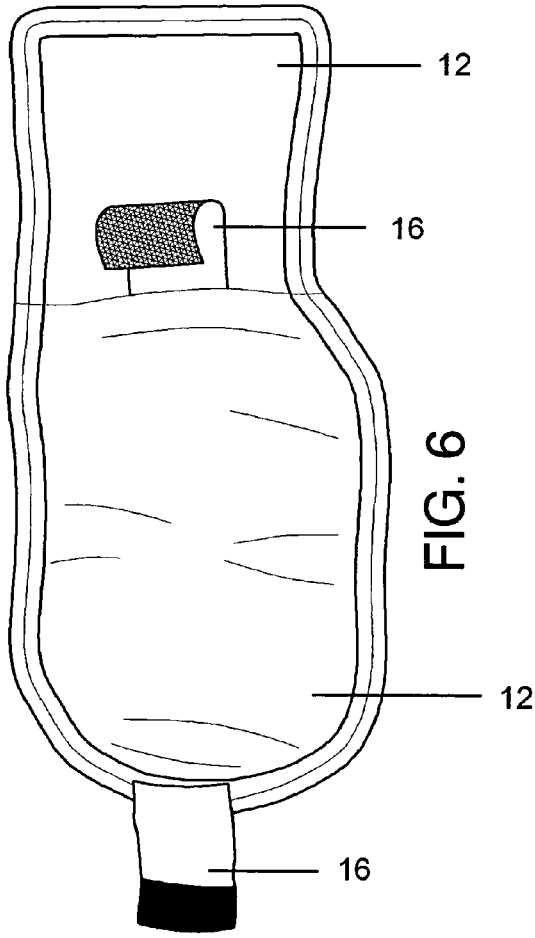
FIG. 6 illustrates a bottom view of the embodiment of the storage attachment.

An optional storage attachment having a primarily longitudinal dimension 12 is illustrated in FIGS. 3, 5 and 6 and includes a fastener 16 that secures the storage attachment substantially perpendicularly to the toy cushion 1 torso and an accessory holder with pockets 14 for storing items such as feeding bottles. The storage attachment is manufactured from hypoallergenic, durable, flame retardant and washable materials. The preferred illustrated embodiment features hook and loop fastener 16 that secures the storage attachment to the toy cushion 1. It is preferable to position the accessory pockets 14 perpendicularly to the longitudinal dimension 12 of the storage attachment. The illustrated storage attachment embodiment resembles a saddle.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A decorative cushion, comprising;

a longitudinal cushion portion comprising a stuffed toy portion that is securable to a chair arm with straps attached to the side of the longitudinal cushion portion, and a toy head portion unsecured to the chair arm; and a storage accessory attachable to the longitudinal cushion portion by a fastener secured to the storage accessory and that is selected from the group consisting of hook and loop, buttons, or snaps, the storage accessory having at least one pocket.

2. The decorative cushion in claim 1 wherein, the toy head portion comprises a mechanically maneuverable stuffed toy portion.

3. The decorative cushion in claim 1 wherein, the stuffed toy portion consists of at least one toy portion selected from the group consisting of leg portions and torso portions.

4. The decorative cushion in claim 2 wherein, the mechanically maneuverable portion is maneuvered by a controller within the decorative cushion.

5. The decorative cushion in claim 4 wherein, the controller comprises a battery powered motor.

6. The decorative cushion in claim 1 wherein, the longitudinal cushion portion further comprises an audible generator.

7. The decorative cushion in claim 6 wherein, the toy head portion comprises a mechanically maneuverable stuffed toy portion.

8. A child care device comprising:

a longitudinal toy torso that is securable to a chair arm along its longitudinal dimension with at least one fastener attached to the longitudinal toy torso, and a mechanically maneuverable toy portion that is unsecured to the chair arm and selected from the group consisting of a toy head, a toy leg, and a toy tail; and a storage accessory having a pocket, said storage accessory attached to the longitudinal toy torso with a fastener attached to the longitudinal dimension of the storage accessory and the storage accessory is securable perpendicularly to the longitudinal toy torso.

9. A method of comforting a child using a decorative cushion as in claim 1, comprising:

securing the stuffed toy portion of the decorative cushion to a chair while leaving a toy head portion of the decorative cushion unsecured to the chair; and positioning an arm that is holding the child against the stuffed toy portion of the decorative cushion.

10. The method of claim 9 further comprising, causing the toy head portion of the decorative cushion to be maneuvered.

11. The method of claim 9 further comprising, causing music to be played.

12. The method of claim 9 wherein, securing the stuffed toy first toy portion to the chair comprises strapping the longitudinal cushion portion to the chair arm.

* * * * *